United States Patent [19]

Herwegh et al.

[11] Patent Number: 4,999,960

[45] Date of Patent: Mar. 19, 1991

[54] CURTAIN WALL PANEL WITH SEALING SYSTEM, SEALING SYSTEM, AND RESPECTIVE SECTION

[75] Inventors: Norbert Herwegh, Schattdorf, Switzerland; Daniel Raulet, Mesnil Saint Denis; Charles Aubert, Saint Cloud, both of France

[73] Assignees: Datwyler France, Bellicourt; Societe en Nom Collectif Sacilor & Cie, Anizy-le-Chateau, both of France

[21] Appl. No.: 358,344

[22] PCT Filed: Jul. 1, 1987

[86] PCT No.: PCT/FR87/00258

§ 371 Date: Apr. 28, 1989

§ 102(e) Date: Apr. 28, 1989

[87] PCT Pub. No.: WO89/00222

PCT Pub. Date: Jan. 12, 1989

[51] Int. Cl.[5] ..... E04B 1/68; E04B 2/88; E04F 15/14; E04H 1/00

[52] U.S. Cl. ..... 52/235; 52/396; 52/403; 52/519; 52/573

[58] Field of Search ..... 52/235, 519, 396, 403, 52/573

[56] References Cited

U.S. PATENT DOCUMENTS

| | | | |
|---|---|---|---|
| 1,366,470 | 1/1921 | Lampert | 52/573 X |
| 2,576,296 | 11/1951 | Green | 52/519 X |
| 3,082,848 | 3/1963 | Keller | 52/235 X |
| 3,124,222 | 3/1964 | Mote | 52/235 X |
| 3,341,975 | 9/1967 | Tylisz . | |
| 3,526,071 | 9/1970 | Watanabe | 52/396 X |
| 3,555,755 | 1/1971 | Reed, III | 52/519 X |
| 3,722,157 | 3/1973 | Prokop | 52/403 |
| 3,817,011 | 6/1974 | Weed | 52/519 X |
| 4,107,892 | 8/1978 | Bellem | 52/403 |
| 4,744,185 | 5/1988 | Lamberet | 52/403 X |
| 4,824,289 | 4/1989 | Glang | 52/396 X |

FOREIGN PATENT DOCUMENTS

| | | | |
|---|---|---|---|
| 294768 | 10/1969 | Australia | 52/403 |
| 2140336 | 1/1973 | France . | |
| 2533001 | 3/1984 | France . | |
| 1121691 | 7/1968 | United Kingdom . | |
| 1467380 | 3/1977 | United Kingdom | 52/403 |
| 2130277 | 5/1984 | United Kingdom . | |
| 2139668 | 11/1984 | United Kingdom . | |

*Primary Examiner*—Richard E. Chilcot, Jr.
*Assistant Examiner*—Deborah McGann Ripley
*Attorney, Agent, or Firm*—Darby & Darby

[57] ABSTRACT

A panel of curtain wall with an air-tight system, which is placed in position before the panel is installed, has an outer air-tight barrier and an inner air-tight barrier, one of which consists of a U-shaped profile with asymmetrical lips, the shorter lip being on the outside of two adjacent sides of the panel, the longer lip being on the outside on the other two sides.

16 Claims, 3 Drawing Sheets

CURTAIN WALL PANEL WITH SEALING SYSTEM, SEALING SYSTEM, AND RESPECTIVE SECTION

Figure 1:
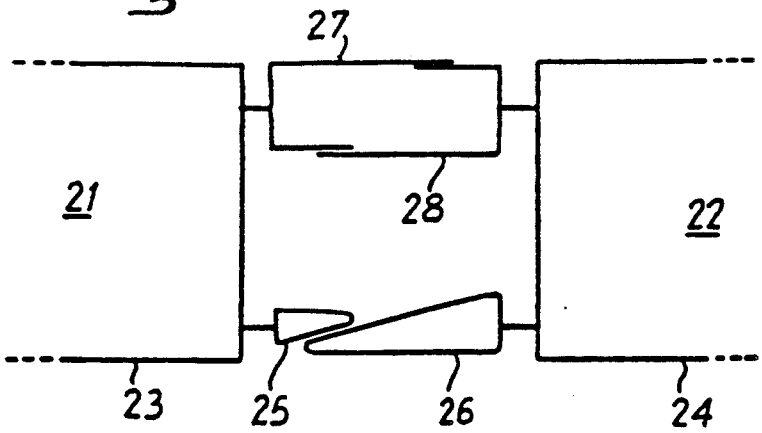

The invention relates to a curtain wall panel with sealing system, a sealing system, and respective sealing sections.

In curtain walls it is common to provide, between two panels, on the one hand an inner seal, on the other hand an outer seal.

The inner seal is generally ensured by means of two identical tubular sections, of rubber or the like, or thermoplastic product, which take support on one another, laterally, when each panel is positioned. These tubular sections, worked in the form of frames whose angles are vulcanized in a specific manner in view of the tubular geometry of these sections, are disposed beforehand on the circumference of a carpenter's bench, whether of metal or not, before this bench is positioned. The outer seal is generally ensured by a section of rubber or the like, or thermoplastic product, with V-shaped throat, running vertically and horizontally on the face of the curtain wall, to cover up all lines of separation between adjacent panels. To assure a good seal at right angles with the zones of juxtaposition of four adjacent panels, it is desirable to arrange in these zones molded connecting pieces between running sections, which comprise a deformation chamber, for example with bellows, in order to absorb the deformations due to the variations in relative position of the panels. These connecting pieces are prefabricated. They are connected by gluing for example, on the face itself. It is therefore necessary to position them on the outside of the face, by means of a "balancelle". This operation takes time and requires relatively costly means, in men and in material.

One of the objects of the present invention is to propose a curtain wall panel with sealing system which avoids any problem of deformation in the zones of juxtaposition of four adjacent panels.

Another object of the invention is to avoid any intervention on the face after the positioning of the panels.

The invention relates to a curtain wall panel with sealing system, of the type in which the sealing system, installed before the positioning of the panel, consists of an outer continuous sealing barrier and an inner continuous sealing barrier, characterized in that the sealing barriers are each formed by sealing sections presenting a small width on two adjacent sides of the panel and a large width on the other two adjacent sides of the panel, in such a way that, as the positioning of a panel occurs by a movement perpendicular to the plane of the panel, the seal packages of two adjacent panels bear on each other laterally.

According to other characteristics of the invention:

- the inner and outer seal barriers consist of sealing sections of different cross section;
- one of the sealing tarriers, inner or outer, consists of an asymmetrical U-shaped section with one long and one short lip;
- the other sealing barrier, outer or inner, consists of a tubular section;
- the other sealing barrier, outer or inner, consists of a section with lip.

The invention also relates to a sealing system for curtain walls, of the type comprising an inner seal and an outer seal, both formed by elastically deformable sections, characterized in that one of the continuous sealing barriers, outer or inner, consists of a U-shaped section comprising a long lip and a short lip so that, as the positioning of a panel is done by a movement perpendicular to the plane of the panel, the long and short lips of the positioned panel rest laterally, respectively, on the short and long lips of the adjacent panel already in place.

According to other characteristics of the invention:

- each of the sections is disposed on a frame integral with a panel of the curtain wall, and installed at the factory so that the positioning of the panel on the construction site ensures correlatively the positioning of the two, outer and inner, sealing barriers;
- the U-shaped sealing section comprises a hook-on foot to ensure its attachment and two lips, one long and the other short, so that the face-to-face arrangement of two actually symmetrical sections ensures the tightness by reciprocal support of their long and short lips respectively;
- when the U-shaped section is positioned in a metal section equipped with turned-up fins, the hook-on foot being maintained under the turned-up fins by shoulders, the lips present a rear shoulder bearing against the fins of the metal section;
- the short lip is substantially perpendicular to the plane of the turned-up fins of the metal section;
- the long lip is slightly inclined toward the short lip;
- on two adjacent sides of the panel, the section is placed with its long lip toward the inside, and on the other two sides it is placed with the long lip toward the outside;
- the other sealing barrier, inner or outer, is formed, on two adjacent sides of the panel, by a short section, and on the other two sides, by a long section;
- the short section faces the short lip of the U-shaped section;
- in the corners of the panel, each of the sections in the form of a frame whose corners are vulcanized or glued presents a widening to improve the tiling of the sections at right angles with the zones of juxtaposition of four panels;
- two opposite corners of the panel present a flat and flexible widening, while the other two corners present a relatively rigid and curved widening;
- the two relatively rigid and curved widenings are disposed with their curvatures inversed in relation to each other;
- at the crossing point of four panels, the two corners with flat and flexible widening are held between the two corners with relatively rigid and curved widening.

The invention also relates to a continuous sealing section of elastically deformable material for curtain wall panels, characterized in that it comprises a hook-on foot to ensure its attachment, and two lips disposed like the arms of a U, one of the two lips being long and the other short, so that the face-to-face arrangement of two mutually symmetrical sections ensures a seal by reciprocal lateral support of their long and short lips respectively.

Figure 2:
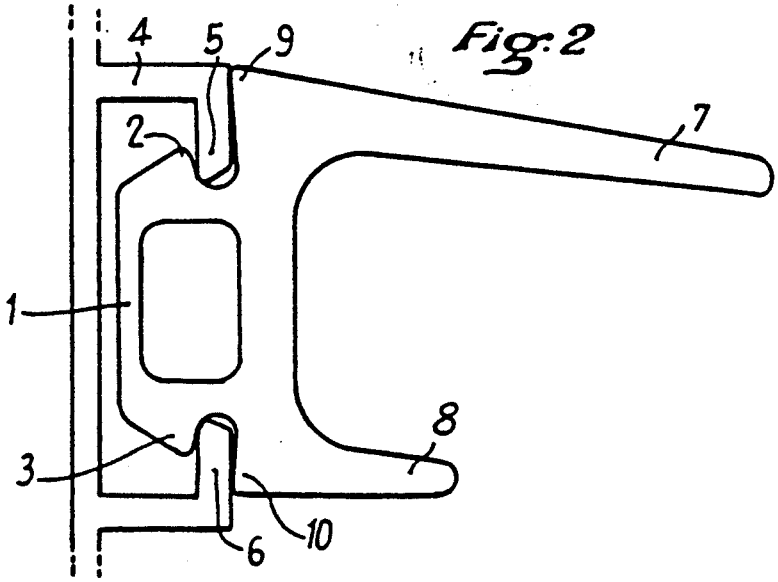
Figure 3:
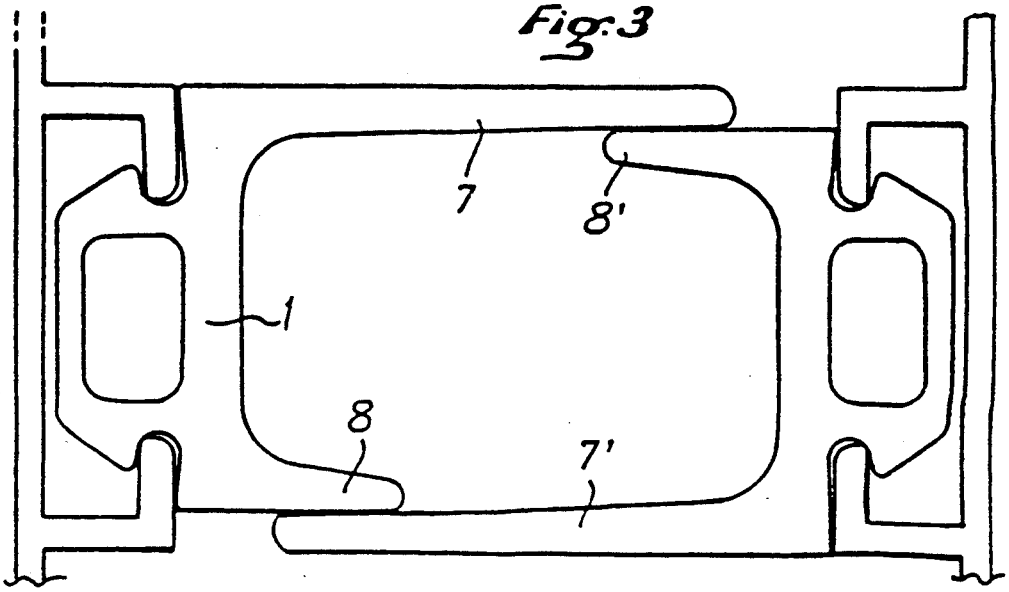
Figure 4:
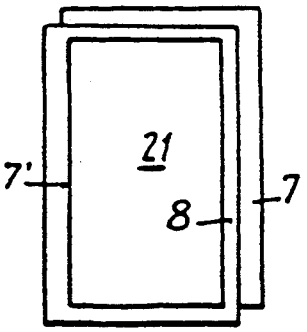
Figure 5:
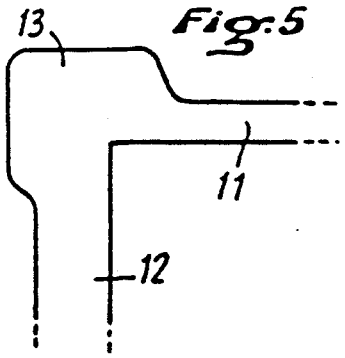
Figure 6:
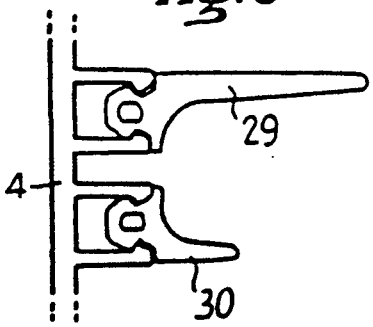
Figure 7:
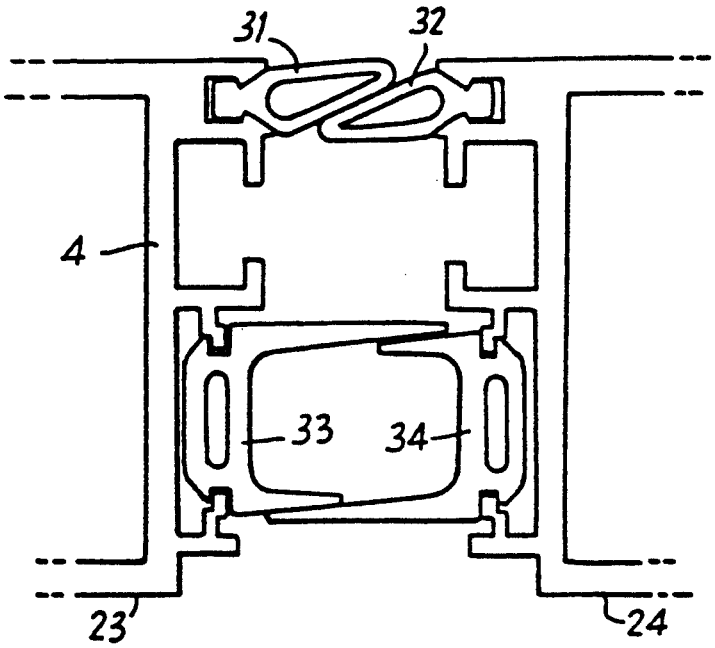
Figure 8:
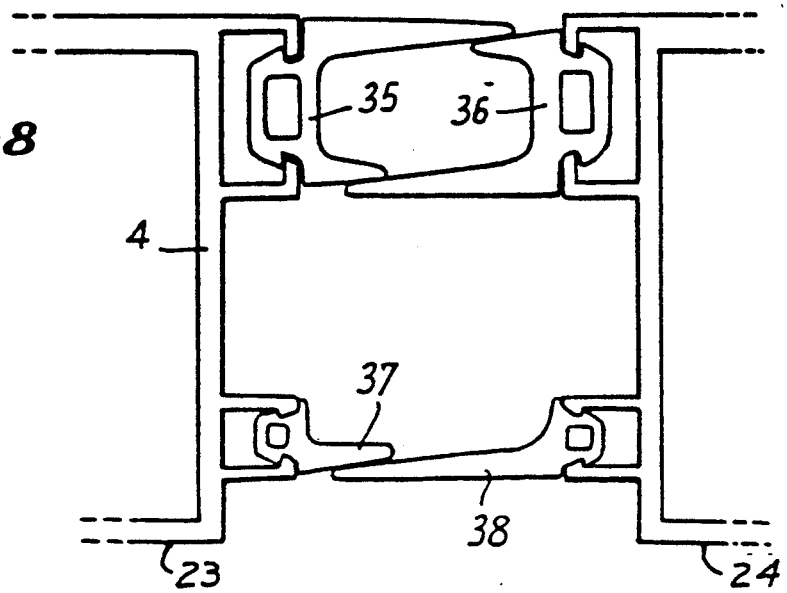
Figure 9:
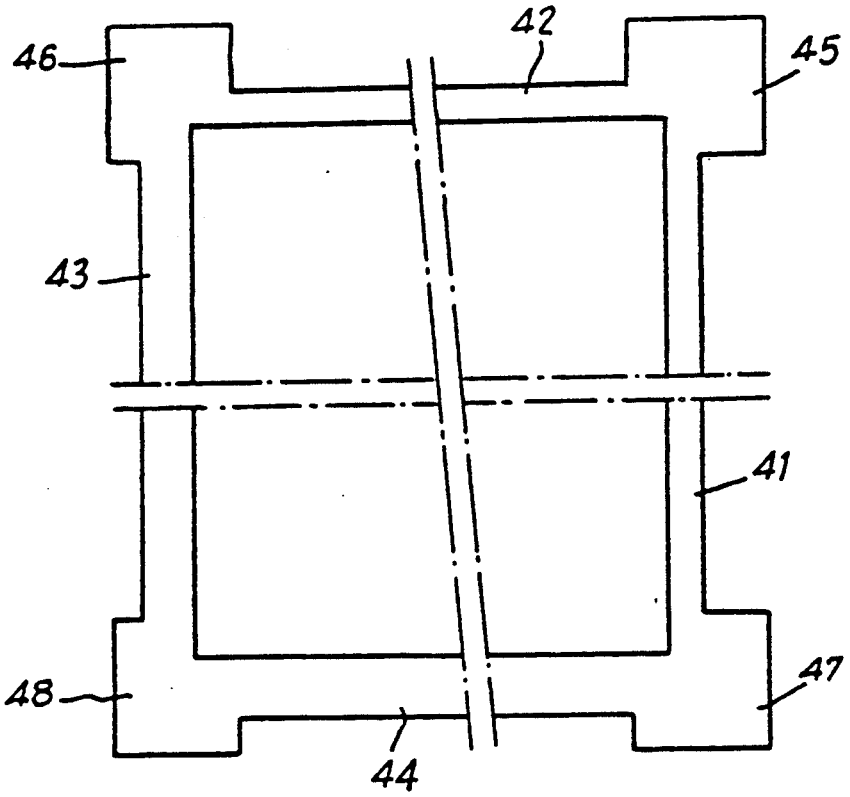
Figure 10:
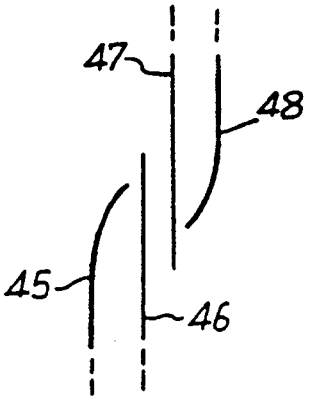
Figure 11:
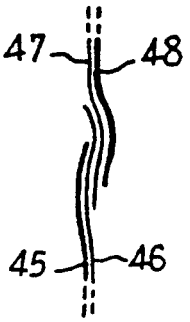

Other characteristics will become evident from the description that follows, made with reference to the annexed drawing in which can be seen:

FIG. 1, a schematic view in transverse section showing the principle of a sealing system for curtain walls, according to the invention;

FIG. 2, a view in transverse section of a sealing section according to the invention in position of rest;

FIG. 3, a view in transverse section of a sealing joint made with two sections according to FIG. 2;

FIG. 4, a schematic view of a curtain wall panel equipped with the sealing section, according to the invention;

FIG. 5, an enlarged view of a curtain wall panel collar showing the widening of the sealing section to improve the tiling at right angles with the zones of juxtaposition of four panels;

FIG. 6, a view in section of another form of realization of a sealing system, according to the invention;

FIG. 7, a view in section of an example of realization of a packing disposed between two curtain wall panels, according to the invention;

FIG. 8, a view in section of another example of realization of a packing disposed between two curtain wall panels, according to the invention;

FIG. 9, a schematic view of the exterior of a rubber frame, only the outer lip of which is shown;

FIG. 10, an exploded view in section of the overlap zone between four adjacent panels;

FIG. 11, a view in section according to FIG. 10, the panels being effectively in place to constitute the curtain wall.

Referring to FIG. 1, one sees in horizontal section two adjacent panels 21 and 22 of a curtain wall. The inner face of these panels bears the references 23 and 24 respectively. Between the two panels, the inner seal is ensured by two tubular sections, not symmetrical with one another, 25 and 26, or by a tubular section and a lipped section in lateral support. The outer seal is ensured by two sections, symmetrical with one another, 27 and 28, whose structure will be described later on. Without going outside the scope of the invention, it can be provided that the faces 23 and 24 of the panels are the outer faces.

Referring to FIG. 2, it is seen that the outer sealing section according to the invention is composed of a hook-on foot 1 with lateral shoulders 2, 3 ensuring its hooking in a metal or other section, schematized at 4. This section, of metal for example, presents two turned-up fins 5 and 6, behind which the shoulders 2 and 3 place themselves.

The outer sealing section presents, in front of its hook-on foot 1, two lips 7 and 8 disposed, like the arms of a U. Lip 7 is long and lip 8 is short. Each of these lips presents a rear shoulder 9, 10, taking support on the fins 5, 6, respectively, of the metal section 4. In position of rest, the short lip 8 is substantially perpendicular to the plane of the fins 5, 6 of the metal section 4, and the long lip 7 is preferably slightly inclined toward the short lip 8.

The outer sealing section according to the invention is made of elastically deformable material, for example of rubber or the like, or of thermoplastic product. Thus, when two sections according to FIG. 2 are placed in the position represented in FIG. 3, the long lips 7, 7' take support on the outside of the short lips 8', 8, respectively, becoming elastically deformed. Because of this elastic deformation, the long lips 7, 7' are urged toward the short lips 8', 8 on which they remain applied, thus ensuring tightness between the panels of the curtain wall. Advantageously, the inner face of the long lip 7 is flat to ensure a better tight support on the short lip 8'.

Preferably, the sealing section according to the invention is manufactured in the form of a frame with vulcanized or glued corners, and placed around a panel, preferably at the factory, but to facilitate the positioning, two adjacent edges of the panel are fitted with a section with the long lip toward the outside (position 7') and the other two adjacent edges are fitted with a section with the long lip toward the inside (position 7). FIG. 4 symbolizes this arrangement. In the example of realization represented in FIG. 3, when the left panel is installed, the right panel can be positioned by simple presentation from the outside. The two tight supports of the long lips 7, 7' on the short lips 8', 8 being realized automatically.

Lastly, to improve the tiling of the sections at right angles with the zones of juxtaposition of four adjacent panels, it is provided to widen the sections in the vicinity of the corners of the panels of the curtain wall.

FIG. 5 represents schematically such a widening 13, between a section with short lip 11 and a section with long lip 12, of the sealing system according to the invention. This widening is made at the factory, at the time of assembly by vulcanization for example, of the sections intended to constitute the sealing frame to be placed on each panel.

Instead of a single U-shaped section like the one of FIG. 2, there may be arranged two sections 29 and 30, one having a single long lip, the other a single short lip, respectively, as shown in FIG. 6. A set of two corresponding sections, carried by the adjacent panel, permits ensuring the tightness as in the case of FIG. 3.

In FIG. 7, the inner face of the panels is again represented at 23 and 24. In the variant of realization represented, the outer seal is ensured by two identical tubular sections 31 and 32 in reciprocal lateral support, and the inner seal is ensured by U-shaped sections, 33 and 34, in the arrangement of FIG. 3.

In the example of realization of FIG. 8, the outer seal is ensured by two U-shaped sections 35 and 36, in the arrangement of FIG. 3, and the inner seal is ensured by a section 37 with short lip and a section 38 with long lip, in reciprocal support. All these sections are positioned at the factory, the asymmetrical U-shaped sections being placed either toward the outside or toward the inside of the curtain wall panels.

In FIG. 9 is schematized a frame of rubber, for example, only the outer lip of which is shown. As the curtain wall panels are positioned from left to right starting from the bottom, the rubber section presents toward the outside a short lip on the sides 41 and 42 and a long lip on the sides 43 and 44. Each corner of the frame presents a widening, respectively 45 at the upper right, 46 at the upper left, 47 at the lower right, 48 at the lower left, the panel being seen from the outside. When positioning the panels, one finds at a crossing four corners with their widenings superposed in the order represented in FIG. 10: 45, 46, 47, 48. According to a special form of realization of the invention, the two corners 46 and 47 are flat and flexible, and the two corners 45 and 48 are relatively rigid and curved.

Their curvature is turned toward the outside for corner 45 and toward the inside for corner 48. In this manner, when the four panels are positioned, the corners are in the arrangement of FIG. 11, bearing against each other and held by the corners 45 and 48 which assure a pressure by reason of their curvature. In this manner, the tightness at the crossing point of four panels is ensured very effectively.

Thus, according to the invention, the curtain wall panels are equipped entirely at the factory with their two sealing frames, inner and outer respectively. The positioning of the panels in a certain order ensures correlatively the correct and definitive positioning of the sealing system, both inner and cuter. It is no longer necessary to provide an intervention on the face, for the positioning of the sealing sections.

We claim:

1. A pre-installed sealing system for the mating and sealing of the edges of two adjacent panels each having inner and outer faces comprising:

first and second sealing barriers of elastomeric deformable material spaced apart and extending along the edge of each said adjacent panels, one barrier adjacent one of the inner and outer panel faces and the other barrier adjacent the other panel face, each of the two sealing barriers on an edge of a panel having a different cross-section, one of said barriers of each panel having, or both barriers formed by, a member of asymmetric U-shaped cross-section having a long extending lip and a short extending lip, the asymmetric U-shaped cross section member on the said edges being positioned opposite each other so that a long lip of one panel U-shaped member and the short lip of the other adjacent panel U-shaped member are generally in line, positioning of the edges of the adjacent panels toward one another brining the long lip and the short lip of the barrier of one panel into an overlying sealing engagement with the short lip and long lip of the other panel.

2. Sealing system according to the assembly of claim 1, characterized in that the short section (25, 37) is opposite the short lip (8) of the U-shaped section.

3. A sealing system as in claim 1, wherein only one of said barriers of each panel is of said asymmetric U-shaped cross-section member and the other barrier has a tubular section, the two tubular sections of the opposing panel edges also coming into an overlying sealing engagement as the panel adjacent edges are moved toward each other.

4. A sealing system as in claim 1, wherein only one of said barriers of each panel is of said asymmetric U-shaped cross-section and the other barrier has a section with an extending arm, the two arms of the opposing panel edges also coming into an overlying sealing engagement as the panel adjacent edges are moved toward each other.

5. A sealing system as in claim 4 wherein the arm of the other barrier on one panel is shorter than the arm of the other barrier on the other panel.

6. Sealing system according to claim 5 wherein the short arm of the other barrier on the one panel is opposite the short lip of the U-shaped section of the one barrier.

7. A sealing system as in claim 1 wherein said barrier of a U-shaped cross-section member includes a foot for hooking into a barrier support on the panel edge, said long and short lips extending from said foot.

8. Sealing system as in claim 7 where the long arm of the other barrier on the other panel lies closer to the longer lip than the shorter lip of the U-shaped section member of the one barrier of said other panel.

9. Sealing system according to claim 7 wherein the barrier support on the panel edge comprises a section having turned-up fins, the foot being maintained under the turned-up fins by shoulders, the lips forming a rear shoulder for support on the turned-up fins of the barrier support.

10. Sealing system according to claim 9 wherein the short lip of an asymmetric U-shaped member is substantially perpendicular to the plane of the turned-up fins of the barrier support.

11. Sealing system according to claim 9 wherein the long lip of an asymmetric U-shaped member is slightly inclined toward the short lip.

12. Sealing system according to claim 1 wherein said panels comprise a separate frame member having the sealing barriers on the edges thereof and a central panel member installed in the frame member.

13. Sealing system according to claim 12 wherein the corners of the frame are vulcanized or glued to present a widening to improve the tilting of the barriers at right angles with the zones of juxtaposition of four panels.

14. Sealing system according to claim 12 wherein the two opposite corners of the frame present a flat and flexible widening, while the other two corners present a relatively rigid and curved widening.

15. Sealing system according to claim 14 wherein the two relatively rigid and curved widenings are disposed with their curvatures inversed relative to each other.

16. Sealing system according to claim 14 wherein at the crossing point of four frames the two corners with flat and flexible widening are held between the two corners with relatively rigid and curved widening.

* * * * *